United States Patent [19]

Benedick et al.

[11] 4,055,247

[45] Oct. 25, 1977

[54] EXPLOSION CONTAINMENT DEVICE

[75] Inventors: William B. Benedick; Charles J. Daniel, both of Albuquerque, N. Mex.

[73] Assignee: The United States of America as represented by the United States Energy Research and Development Administration, Washington, D.C.

[21] Appl. No.: 734,834

[22] Filed: Oct. 22, 1976

[51] Int. Cl.[2] ..... F42B 37/02

[52] U.S. Cl. ..... 206/3; 206/591; 220/288

[58] Field of Search ..... 89/34; 206/3; 220/15, 220/288

[56] References Cited

U.S. PATENT DOCUMENTS

| | | | |
|---|---|---|---|
| 3,072,022 | 1/1963 | Wood et al. | 206/3 |
| 3,160,061 | 12/1964 | Moy | 206/3 |
| 3,160,062 | 12/1964 | Moy et al. | 206/3 |
| 3,603,107 | 9/1971 | Elliott et al. | 220/15 |
| 3,757,933 | 9/1973 | Banta | 206/3 |

*Primary Examiner*—Stephen C. Bentley

*Attorney, Agent, or Firm*—Dean E. Carlson; Dudley W. King; Robert W. Weig

[57] ABSTRACT

The disclosure relates to an explosives storage container for absorbing and containing the blast, fragments and detonation products from a possible detonation of a contained explosive. The container comprises a layer of distended material having sufficient thickness to convert a portion of the kinetic energy of the explosion into thermal energy therein. A continuous wall of steel sufficiently thick to absorb most of the remaining kinetic energy by stretching and expanding, thereby reducing the momentum of detonation products and high velocity fragments, surrounds the layer of distended material. A crushable layer surrounds the continuous steel wall and accommodates the stretching and expanding thereof, transmitting a moderate load to the outer enclosure. These layers reduce the forces of the explosion and the momentum of the products thereof to zero. The outer enclosure comprises a continuous pressure wall enclosing all of the layers. In one embodiment, detonation of the contained explosive causes the outer enclosure to expand which indicates to a visual observer that a detonation has occurred.

6 Claims, 3 Drawing Figures

EXPLOSION CONTAINMENT DEVICE

FIELD OF THE INVENTION

The invention relates to explosion containment and more particularly to a shipping and storage container for explosives capable of absorbing and containing the blast, fragments, and detonation products from a possible detonation of an explosive contained therein.

BACKGROUND OF THE INVENTION

Because of the increasing need for weapons systems security and for safeguarding individual weapons system components, such as artillery projectiles, high explosive devices and nuclear warheads, there exists at present a demand for shipping and storage containers for such devices. Such a container should be capable of containing an explosion of a device held therein for the safety of personnel and property in the surrounding vicinity. Moreover, a container which holds a detonated device may be altered thereby so that visual monitoring, even at a distance, will uncover a container or containers holding detonated devices.

Shipping and storage containers contemplated for weapons components must be capable of being handled by military or other authorized personnel without extreme difficulty, and should also be capable of being shipped by rail, truck, plane, ship or the like with reasonable dispatch. At the same time, it may be desirable for the containers to be sufficiently bulky and heavy that their theft cannot be easily carried out. For example, the containers could be sufficiently light to be handled by military personnel having the proper equipment and carried by, for example, two and a half ton military trucks, cargo planes, ships and railroad cars. The containers, however, could be sufficiently difficult to handle that they could not be manually lifted by two or three men and loaded into a half or three-quarter ton pickup truck.

Explosives containers should be sufficiently sturdy that they will, as well as contain an explosion of the device therein, withstand ground fire from, for example, thirty caliber military weapons, the pounding of sledge hammers and inadvertant dropping from heights up to ten feet, without sustaining sufficient damage to detonate the device therein or reducing the explosion containing capability of the container or damaging the contained device. Containers must also be capable of protecting the devices contained within from injury such as might be encountered during routine handling by authorized personnel. Both the contained explosive device and the safeguarding electronics within the container must be protected.

SUMMARY OF THE INVENTION

In accordance with the present invention there is provided a shipping and storage container for containing the possible detonation of an explosive device stored therein. The container comprises an inner layer of distended material enclosing the explosive; this layer has sufficient thickness to convert a portion of the kinetic energy of an explosion into thermal energy within the distended material as the material shock compresses. A continuous wall of steel encloses the distended material layer. This continuous steel wall is sufficiently thick to absorb by stretching and expanding a portion of the kinetic energy and detonation product momentum produced by the detonation of the explosive. Outwardly disposed from the continuous wall is a crushable layer for transmitting forces and for accommodating the stretching and expanding of the continuous wall. The outer wall of the container comprises a continuous wall which in one embodiment expands to absorb the remaining kinetic energy and detonation product momentum resulting from the explosion so that an explosion caused expansion of the outer layer is optically visible to an observer. Alternatively, the outer layer or inner layers may be sufficiently strong that the outer continuous wall does not expand upon detonation of the encased explosive.

One object of the present invention is to convert kinetic energy resulting from an explosion within a container into thermal energy enabling a reduction in the amount of structurally strong material needed to successfully contain an explosion.

Another object of the present invention is to provide a visible indication when a container encased explosive is detonated.

Still another object of the present invention is to provide reasonably economical and compact storage for explosive devices.

Yet another object of the present invention is to provide a container sufficiently heavy and bulky that it cannot be easily carried off by unauthorized persons lacking special handling equipment.

One advantage of the present invention is that in accordance therewith, explosive devices can be safely stored and shipped at reasonable cost.

Another advantage of the present invention is that explosives stored in containers in accordance therewith can be safely handled to such an extent that if the container is inadvertently dropped from a substantial height or is struck by a sizable weight with sufficient force, it and the device contained therein will sustain insufficient damage to render them usable.

Still another advantage of a container in accordance with the instant invention is that such a container is reasonably easy to handle using authorized personnel having the proper equipment, but it is extremely difficult for unauthorized persons lacking such equipment to carry it off.

Yet another advantage of the instant invention is that a container in accordance therewith containing a detonated explosive may be visually discernible from those containing undetonated explosives.

Yet still another advantage of the instant invention is that a container in accordance therewith may have a self-sealing lid to better contain an explosion.

BRIEF DESCRIPTION OF THE DRAWINGS

Other objects and advantages of the present invention will be apparent to those skilled in the art from the following disclosure with reference to the appended drawings wherein like numbers denote like parts and wherein.

DETAILED DESCRIPTION OF A PREFERRED EMBODIMENT OF THE INVENTION

Figure 1:
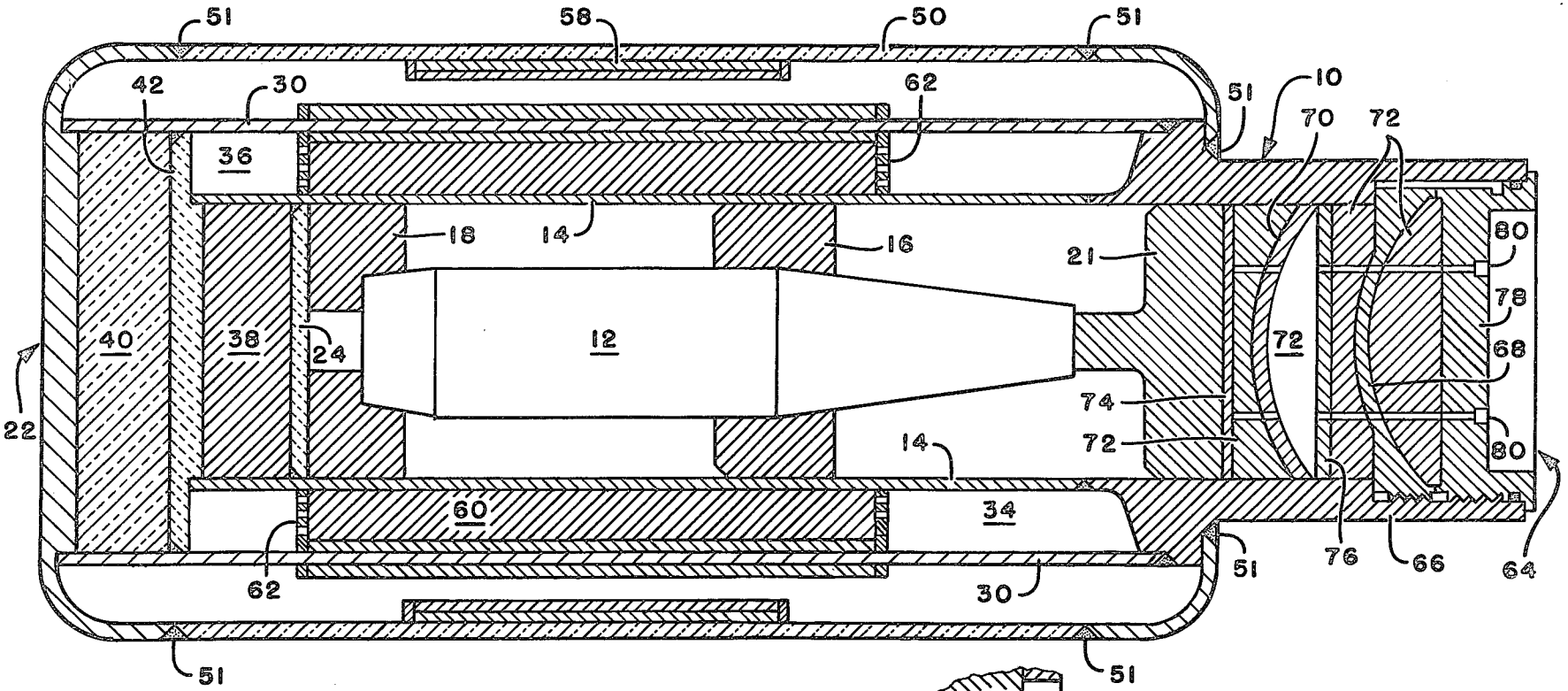
FIG. 1 is a cutaway view of a container in accordance with the present invention.

The Figure illustrates a preferred embodiment of the invention 10 containing an explosive device such as a weapon projectile 12 secured within a first steel layer 14 by blocks 16, 18 and 21. It will be appreciated that the weapon or other device 12 contains an explosive to be contained by container 10 and that device 12 is itself no part of the instant invention. The blocks 16 and 18 may be circumferential so that they run 360° around projectile 12. Alternatively, they may be segmented into arc forming blocks that are spaced about the projectile 12. At base end 22 of container 10, base plate 24, affixed to layer 14 by, for example, welds, supports blocks 18 and thereby projectile 12. Between layer 14 and a second steel layer 30 is disposed a fill 34 distended material. Distended material may be defined as anything having less than solid density for that material. A base plate 42 is affixed to steel layer 30.

The preferred distended materials which may be utilized as filler 34 in accordance with the present invention are Feltmetal, a trademark of the Brunswick Corp., sintered iron, microballoon filled epoxy, titanium and nickel powders, small diameter thin walled tubing, wire rope, wound wire, iron powders, steel cables, syntactic foams, ceramic and glass fibers, metal fibers such as steel wool, and organic fibers such as carbon filaments and Kevlar, a trademark of the DuPont Company. In order to save weight, microballoon filled epoxy 36 is disposed in the base region between steel layers 14 and 30 because shrapnel, in the event of an explosion of projectile 12, in this region of the container would be minor. At base portions 40 and 38 between elements 22 and 42, and 42 and 24 respectively, honeycombed material or crushable distended material such as microballoon filled epoxy may be used. Once again this material will save weight and can be utilized in a region of the container not expected to suffer large amounts of shrapnel in the event of an explosion or detonation of the explosive contained in projectile 12. An outer layer of steel 50 which comprises base 22 and extends about the aforementioned layers 14 and 30 is welded together at welds 51.

Figure 2:
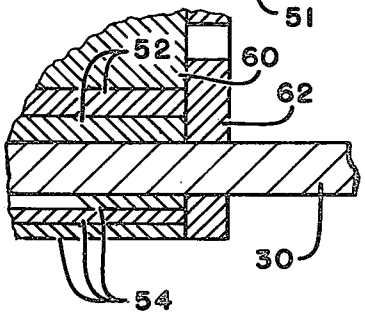
FIGS. 2 and 3 are expanded views of portions of the FIG. 1 container.
Figure 3:
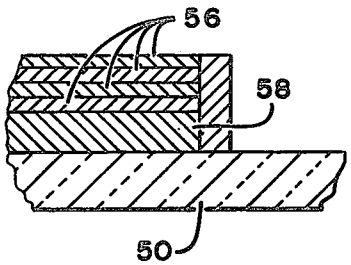

As seen in FIGS. 2 and 3 a plurality of cold rolled stainless steel strips 52, 54 and 56 are wrapped around layers 30 and about the inner side of outer layer 50 to provide maximum deformation resistance for the region of the container which would receive the greatest amount of detonation product momentum and kinetic energy in the event of a detonation.

If the outer enclosure 50 is not to be deformed in the event of an explosion, a very high strength cold rolled stainless steel strip i.e. greater than 200,000 psi yield and 1 to 3% maximum elongation is utilized in strips 56. Feltmetal 58 serves to physically separate strips 56 from outer enclosure 50 and allows the strips 56 to elongate a small amount by crushing without over stressing outer enclosure 50.

Thus, strips 52, 54, and 56 control the amount of radial expansion of layers 30 and 50 and, also minimize the weight and amount of materials to build the container. These layers act as a reinforcement zone where expected detonation, kinetic energy and momentum is the greatest. Cold rolled stainless steel strips are advantageous in that they display greater strength and less elongation than annealed material. The container can be set up to contain devices of various yields so that it will either contain the explosion without a plastic deformation of the outer wall 50 or with such a deformation at the users option.

Between layers 14 and 30 in the region shown as 60 a distended material is utilized to fill the portion adjacent strip 52. Once again, the material may comprise Feltmetal, sintered iron powder, wire rope, microballoon filled epoxy and the other above noted materials. In order to contain such materials where desired, a baffle 62 may be provided.

A lid 64 having convex steel portions 68 and 70 threads into neck portion 66. Crushable filler 72 is disposed between steel portions 74, 70, 76 68 and 78. Vents 80 may be provided for post detonation bleeding. Lid 64 is self-sealing in that in the event of a detonation, the shock waves' action on the convex portions 68 and 70 acts to force the threaded periphery of lid 64 into the corresponding threads on neck 66.

The various features and advantages of the invention are thought to be clear from the foregoing description. However, various other features and advantages not specifically enumerated will undoubtedly occur to those versed in the art, as likewise will many variations and modifications of the embodiments illustrated herein, all of which may be achieved without departing from the spirit and scope of the invention as defined by the appended claims.

We claim:

1. An explosive shipping container for absorbing the explosion energy and containing the products of an explosive disposed therein, said container comprising:

an inner layer of steel forming a cylindrical essentially gas-tight innermost chamber;

means for supporting said explosive within said chamber; intermediate and outer layers of steel spaced from said inner layer and from each other substantially enclosing said innermost chamber;

filler comprising distended and crushable material disposed about said chamber between said inner and intermediate steel layers; and a plurality of cold rolled stainless steel strips spaced from and encircling said explosive to enclose the area of maximum expected shrapnel density, wherein at least one of said steel strips is disposed between said inner and intermediate steel layers adjacent to said intermediate steel layer, said container being sufficiently strong to fully contain the explosion effects of an explosive disposed in said innermost chamber.

2. The invention of claim 1 wherein at least one of said steel strips is disposed between said intermediate and outer steel layers adjacent to said intermediate layer.

3. The invention of claim 2 wherein at least one of said steel strips is disposed between said intermediate and outer steel layers, said strips being closer to said outer layer than to said intermediate layer.

4. The invention of claim 3 further comprising a belt of distended material encircling between said last mentioned steel strips and said outer steel layer providing a cushioning effect between said strips and said outer layer upon an explosion of an explosive within said container.

5. The invention of claim 4 wherein said last mentioned steel strips and said outer steel layer are sufficiently strong to retain the explosion energy and explosion products with up to 10% expansion thereof.

6. The invention of claim 1 wherein said steel outer layer comprises a threaded neck and a threaded lid is threadable into said neck, said lid having at least one steel element with a convex surface facing toward an explosive disposed within said container, such that the explosion of said explosive causes said element having said convex surface to force the threads of said lid into the threads of said neck to securely lock said lid therein.

* * * * *